US007207265B2

(12) United States Patent
Helmstädter

(10) Patent No.: US 7,207,265 B2
(45) Date of Patent: Apr. 24, 2007

(54) DEVICES FOR TURNING SHEETS IN A SHEET-FED ROTARY PRINTING MACHINE

(75) Inventor: Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 139 days.

(21) Appl. No.: 10/704,261

(22) Filed: Nov. 7, 2003

(65) Prior Publication Data

US 2004/0094052 A1 May 20, 2004

Related U.S. Application Data

(62) Division of application No. 09/688,024, filed on Oct. 13, 2000, now Pat. No. 6,722,276.

(30) Foreign Application Priority Data

Oct. 13, 1999 (DE) ..... 199 49 412

(51) Int. Cl.
*B41F 21/10* (2006.01)

(52) U.S. Cl. ..... 101/230; 101/229; 101/246; 101/409

(58) Field of Classification Search ..... 101/216, 101/217, 220, 222, 223, 229, 230, 246, 409
See application file for complete search history.

(56) References Cited

U.S. PATENT DOCUMENTS 3,884,146 A 5/1975 Ruetschle
4,122,773 A * 10/1978 Wirz ..... 101/230
4,378,734 A * 4/1983 Wirz ..... 101/230
4,723,489 A 2/1988 Emrich et al.
4,930,414 A * 6/1990 Wirz ..... 101/183
5,042,384 A * 8/1991 DeMoore et al. ..... 101/483
5,063,843 A * 11/1991 Becker ..... 101/183
5,406,884 A * 4/1995 Okuda et al. ..... 101/137
5,598,779 A 2/1997 Haas et al.
5,701,819 A 12/1997 Stephan (Continued)

FOREIGN PATENT DOCUMENTS

DE 1 102 767 3/1961

(Continued)

*Primary Examiner*—Daniel J. Colilla
*Assistant Examiner*—Kevin D. Williams
(74) *Attorney, Agent, or Firm*—Laurence A. Greenberg; Werner H. Stemer; Ralph E. Locher

(57) ABSTRACT

Devices for turning sheets in a rotary printing machine are described. The devices have a storage drum for handling sheets, which are each held by a holding device, and a turning drum is disposed downstream of the storage drum and has a holding device for engaging a rear edge of the sheet to be turned. An operation of detaching the sheet to be turned from the storage drum and carrying it along by the turning drum leads to the formation of a pressure reduction in an area formed between the sheet to be turned, the storage drum and the turning drum. The pressure reduction is compensated for by supplying ambient air, blast air and/or compressed air. The turning device has a channel and/or a passage orifice connected to an inner chamber of the turning drum. Via the channel and/or passage orifice air can be sucked and/or blown into the reduced-pressure area.

7 Claims, 10 Drawing Sheets

U.S. PATENT DOCUMENTS

| | | | |
|---|---|---|---|
| 5,787,810 | A | 8/1998 | Stephan |
| 5,979,318 | A | 11/1999 | Helmstädter |
| 6,089,156 | A | 7/2000 | Stephan |
| 6,254,089 | B1 | 7/2001 | Becker et al. |

FOREIGN PATENT DOCUMENTS

| | | | |
|---|---|---|---|
| DE | 54 703 | | 3/1967 |
| DE | 94 11 462.5 | | 10/1994 |
| DE | 44 34 778 | C1 | 11/1995 |
| DE | 44 24 968 | A1 | 1/1996 |
| DE | 44 24 968 | C2 | 1/1996 |
| DE | 44 42 301 | A1 | 3/1996 |
| DE | 197 13 361 | A1 | 10/1998 |
| DE | 198 48 441 | A1 | 6/1999 |
| EP | 0 778 131 | A1 | 6/1997 |

* cited by examiner

DEVICES FOR TURNING SHEETS IN A SHEET-FED ROTARY PRINTING MACHINE

CROSS-REFERENCE TO RELATED APPLICATION

This application is a divisional of U.S. application Ser. No. 09/688,024, filed on Oct. 13, 2000, now U.S. Pat. No. 6,722,276.

BACKGROUND OF THE INVENTION

Field of the Invention

The invention relates to a device for turning sheets in a sheet-fed rotary printing machine in which the device has a storage drum for handling sheets and a turning drum disposed downstream of the storage drum for turning the sheets.

German Patent DE 44 24 968 C2 discloses a turning device of the type discussed above which has a storage drum, on the outer lateral surface of which a plurality of sheets are held. In a direction of movement of the sheets, a turning drum, which has a holding device for engaging a rear edge of the sheet to be turned, is disposed downstream of the storage drum. The configuration of the storage drum and the turning drum is selected such that their lateral surfaces virtually touch one another at a tangent point. The storage drum has a first blowing device, with the aid of which a stream of blast air can be applied to the sheet which has already been taken hold of by the holding device, in order to press the sheet off the storage drum, assisting with the operation of turning the sheet. Moreover, to assist with the turning operation, a second blowing device is provided above the tangent point, with the aid of which air can be blown into the tangent point in order to press the sheet to be turned downward and thus to assist with detaching the sheet from the storage drum.

By detaching the sheet to be turned from the circumference of the storage drum and conveying it onward with the aid of the turning drum, air situated in the turning area is entrained by the sheet, resulting in a local pressure reduction which acts on the next sheet, which is held on the circumferential surface of the storage drum with the aid of the holding device and as a result may be at least partially lifted off the storage drum. Consequently, an in-register transfer of the sheets from the storage drum to the turning drum cannot be ensured in all cases. This occurs because, when turning the rear edge of sheets, to ensure an in-register transfer of the sheet stored on the storage drum, in particular in the case of face-side printing and perfecting, it is necessary to produce precise conditions for the entire path of the stored sheet. For this purpose, the sheet is usually clamped on the storage drum surface at the rear edge by clamping suckers, so that all the sheets come to rest in exactly the same position during the storage operation. In the case of half-turn storage drums, the uniformity of the two halves of the storage drum is ensured by an accurately ground surface. However, perfect transfer of the sheet stored in this way is only ensured if the sheet can be held in this state or position by the clamping suckers. However, this is not the case with a high printing capacity, which may, for example, amount to 15,000 sheets per hour.

With a printing capacity which is as high as this, with only approximately 0.1 second between the instant at which the leading sheet is detached and that at which the next sheet enters the reduced-pressure zone, it is impossible for sufficient air to flow into the reduced-pressure zone which is formed between the turning drum and the storage drum in the space between the turning drum and the storage drum. The blast streams from the first and second blowing devices of the known turning device, which serve to assist with the turning operation, cannot sufficiently reduce the pressure reduction which is active in the turning area, since the blast-air stream of the second blowing device disposed above the tangent point, owing to the very small space between the storage drum and the turning drum, can only reach the turning area lying beneath the tangent point in a weakened form, if at all. The first blowing device disposed in the storage drum is only active for a very short time in order to lift the sheet resting on the storage drum at its rear-edge area. Also, the pressure differences that are customary with blast air and the outlet cross sections of the blowing nozzles are too small to compensate for the pressure reduction that is generated.

SUMMARY OF THE INVENTION

It is accordingly an object of the invention to provide devices for turning sheets in a sheet-fed rotary printing machine which overcome the above-mentioned disadvantages of the prior art devices of this general type, in which an in-register transfer of the sheet stored on the circumferential surface of the storage drum can be ensured even at a high press speed.

With the foregoing and other objects in view there is provided, in accordance with the invention, a sheet turning device for a sheet-fed rotary printing machine. The sheet turning device is formed of a storage drum for handling at least two sheets and has at least one holding device for each of the sheets; and a turning drum disposed downstream of the storage drum and has at least one holding device for engaging a rear edge of a sheet of the sheets to be turned. An operation of detaching the sheet to be turned from the storage drum and carrying it along by the turning drum leads to a formation of a pressure reduction in a reduced-pressure area formed between the sheet to be turned, the storage drum and the turning drum. The turning drum has a lateral surface with at least one channel formed therein in which air can be at least one of sucked from and blown into the reduced-pressure area.

The device is distinguished by the fact that at least one channel and/or at least one passage orifice is connected to an inner chamber of the turning drum, via which channel and/or passage orifice air can be sucked and/or blown into the reduced-pressure area. A free cross section of flow of the channel running, for example, in the circumferential direction of the turning drum and, if appropriate, that of the passage orifice are sufficiently large for a pressure reduction which is formed in the area between the storage drum. The turning drum and the sheet to be turned as a result of the sheet to be turned being detached from the storage drum and as a result of the turning operation to be able to suck in at least enough air through the channel and/or the passage orifice for it to be possible to prevent the next sheet, which is resting on the outer circumferential surface of the storage drum, from being lifted off. In this variant, it is possible to dispense with blowing devices which supply blast air and/or compressed air to the reduced-pressure area, a fact which simplifies the structure of the turning device. In another variant, at least one blast-air/compressed-air supply device is provided, which, by way of example, supplies the inner chamber of the turning drum with blast air or compressed air which passes via the passage orifice in the turning-drum lateral surface, into the reduced-pressure area. The at least one passage orifice is disposed downstream—as seen in the direction of rotation of the turning drum—of the holding device which holds the rear edge of the sheet to be turned and is provided on the turning drum. As an alternative or in addition, it is also possible for a blast-air/compressed-air stream to be introduced into the reduced-pressure area via the channel. A common feature of all these exemplary embodiments is that the incoming flow of air via the channel and/or the passage orifice into the reduced-pressure area is at least assisted by the pressure reduction acting in that area.

According to a refinement of the invention, at least one wall of the channel is formed at least in part by a flattened section made in the lateral surface of the turning drum. In connection with the present invention, the term "flattened section" is understood as meaning a planar or substantially planar area on a circular or curved surface. In an advantageous embodiment, the turning drum, in the region of the flattened section, has for the most part a substantially round cross section, the channel wall having a different, preferably smaller radius of curvature, at least in its area disposed upstream of the flattened section—as seen in the direction of flow of the air—from the turning drum.

In accordance with an added feature of the invention, the holding device of the turning drum has at least one gripper disposed on the flattened section.

In accordance with an additional feature of the invention, the turning drum has a circumference, and the channel formed in the lateral surface of the turning drum runs over region of the circumference of the turning drum.

In a further embodiment, the device is distinguished by the fact that at least one open-edged recess, at least one channel and/or at least one passage orifice connected to an inner chamber of the storage drum is/are provided in the lateral surface of the storage drum. Via the recess, channel and/or passage orifice air can be introduced into the reduced-pressure area. The recess, which may, for example, extend over the entire length of the storage drum, is closed laterally, i.e. toward the edge of the machine, and in the circumferential direction at least to a sufficient extent for it to be impossible for air which has been blown in from its open side to escape. The "air cushion", which has been introduced into the recess and is introduced into the reduced-pressure area with the aid of at least one blowing device immediately before entry into the recess, is sucked out of the recess in the turning area by the reduced pressure prevailing in that area, with the result that the reduced pressure in the turning area can be reduced at least to a level which is not dangerous. The recess, which is disposed in a free area between two sheets resting on the storage drum, may be sufficiently extensive, in the circumferential direction of the storage drum, for a direct passage between an area of the sheet-fed rotary printing machine which lies above the roll nip formed between the turning drum and the storage drum and the reduced-pressure area to be formed for a brief period in a specific rotation-angle position of the storage drum, so that ambient air can flow and/or blast/compressed air can be blown directly into the reduced-pressure area via the recess which is open toward the outer lateral surface of the storage drum. In addition, or as an alternative, air can be sucked or blown out of the inner chamber of the storage drum, which may be connected to a blast-air/compressed-air supply device, into the reduced-pressure area via the passage orifice. In another embodiment, air is fed to the reduced-pressure area via the channel that is connected to the environment and/or interacts with a blowing device.

In another embodiment, the device is distinguished by the fact that the turning drum is eccentrically mounted and the holding device is disposed on this drum in such a manner that at the very moment at which the sheet rear edge is picked up by the holding device, a free space is formed between the turning drum and the storage drum. With the aid of the free space which is left clear between the opposite outer lateral surfaces of the storage drum and the turning drum, it is possible to produce a flow connection between the environment and the reduced-pressure area delimited by the sheet to be turned, the turning drum and the storage drum. The free cross section of flow of the free space is at least large enough for it to be possible for a sufficient amount of air to flow or be introduced into the reduced-pressure area during the turning operation, so that in this area the pressure reduction which is formed by the entrained air when the sheet is turned can be reduced to a level which is not dangerous and in this way it is possible to prevent the next sheet, which is resting on the storage drum, from being lifted off. Ambient air can preferably flow in through the free space of its own accord. It is also possible for blast air to be blown into the turning area of the sheet through the free space.

In an additional embodiment, the device is distinguished by the fact that the turning drum, at least on its outer side, has—as seen in cross section—at least one flattened section which—as seen in the direction of rotation of the turning drum—is disposed downstream of the holding device, which is provided on the turning drum, for the sheet rear edge. The flattened section, which is formed by at least one planar or substantially planar area made on the outer side of the turning drum serves to produce a free space between the turning drum and the storage drum in a defined rotational position of the turning drum, through which free space air can be introduced into the turning area of the sheet which has been taken hold of by the holding device of the turning drum. In this case too, it is possible to reliably prevent the next sheet, which is held on the circumference of the storage drum, from being lifted off in the turning area by an excessive pressure reduction.

In accordance with another embodiment, the device is distinguished by the fact that compressed air can be introduced laterally into the reduced-pressure area by at least one fixedly disposed blowing device. The compressed air or blast air may, for example, be blown directly into the reduced-pressure area or—in an advantageous embodiment of the turning device—may be blown into a distributor chamber which is provided in the storage drum and is in preferably direct communication with the reduced-pressure area via at least one flow path.

In an advantageous exemplary embodiment of the turning device, the storage drum may simultaneously also serve as an impression cylinder or may be formed by an impression cylinder.

With the foregoing and other objects in view there is further provided, in accordance with the invention, a sheet turning device for a sheet-fed rotary printing machine. The sheet turning device is formed of a storage drum for handling at least two sheets and has at least one holding device for each of the sheets, a lateral surface, at least one open-edged recess formed therein, at least one inner chamber formed therein, and at least one passage formed therein and connects the inner chamber of the storage drum to the lateral surface. A turning drum is disposed downstream of the storage drum and has at least one holding device for engaging a rear edge of a sheet of the sheets to be turned. An operation of detaching the sheet to be turned from the storage drum and carrying it along by the turning drum leads to a formation of a pressure reduction in a reduced-pressure area formed between the sheet to be turned, the storage drum and the turning drum. Via the open-edged recess and the passage of the storage drum air can be introduced into the reduced-pressure area.

In accordance with an added feature of the invention, the air can be at least one of sucked from and blown into the reduced-pressure area via the passage.

In accordance with an additional feature of the invention, the reduced-pressure area is in communication with the lateral surface of the storage drum via the passage. The lateral surface of the storage drum has at least one of at least one further channel and at least one further passage orifice formed therein connecting the inner chamber of the storage drum to an area of the lateral surface on which a subsequent sheet is resting.

In accordance with another feature of the invention, an air supply is connected to the passage and is selected from the group consisting of a compressed-air supply device, a blast-air supply device and the environment.

In accordance with a further added feature of the invention, the holding device of the storage drum is disposed in the open-edged recess.

In accordance with a further additional feature of the invention, the turning drum has an inner chamber formed therein, a lateral surface, and at least one passage orifice formed therein and connecting the inner chamber to the lateral surface of the turning drum, and through the passage orifice air can be at least one of sucked from and blown into the reduced-pressure area.

In accordance with another added feature of the invention, the passage is formed of a channel connected to a passage orifice.

With the foregoing and other objects in view there is additionally provided, in accordance with the invention, a sheet turning device for a sheet-fed rotary printing machine. The sheet turning device is formed of a storage drum for handling at least two sheets and has at least one holding device for each of the sheets; and a turning drum disposed downstream of the storage drum and has at least one holding device for engaging a rear edge of a sheet of the sheets to be turned. An operation of detaching the sheet to be turned from the storage drum and carrying it along by the turning drum leads to a formation of a pressure reduction in a reduced-pressure area formed between the sheet to be turned, the storage drum and the turning drum. The turning drum is an eccentrically mounted turning drum and the holding device of the turning drum is disposed on the turning drum such that at a moment at which the rear edge of the sheet is engaged by the holding device of the turning drum, a free space is formed between the turning drum and the storage drum.

In accordance with an added feature of the invention, the storage drum has an outer lateral surface; and the turning drum has an outer lateral surface and is configured such that, in a defined rotation-angle position of the turning drum, a distance between the outer lateral surface of the turning drum and the outer lateral surface of the storage drum is virtually zero.

In accordance with an additional feature of the invention, the turning drum has an outer lateral surface with at least one flattened section and the holding device of the turning drum is disposed on the flattened section.

In accordance with another feature of the invention, the turning drum has a given length and the flattened section extends over an entire length of the given length.

With the foregoing and other objects in view there is additionally provided, in accordance with the invention, a sheet turning device for a sheet-fed rotary printing machine. The sheet turning device is formed of a storage drum for handling at least two sheets and has at least one holding device for each of the sheets; and a turning drum disposed downstream of the storage drum and has at least one holding device for engaging a rear edge of a sheet of the sheets to be turned. An operation of detaching the sheet to be turned from the storage drum and carrying it along by the turning drum leads to a formation of a pressure reduction in a reduced-pressure area formed between the sheet to be turned, the storage drum and the turning drum. The turning drum has an outer side with at least one flattened section which, as seen in a direction of rotation of the turning drum, is disposed downstream of the holding device of the turning drum.

With the foregoing and other objects in view there is additionally provided, in accordance with the invention, a sheet turning device for a sheet-fed rotary printing machine. The sheet turning device is formed of a storage drum for handling at least two sheets and has at least one holding device for each of the sheets and a turning drum disposed downstream of the storage drum and having at least one holding device for engaging a rear edge of a sheet of the sheets to be turned. An operation of detaching the sheet to be turned from the storage drum and carrying it along by the turning drum leads to a formation of a pressure reduction in a reduced-pressure area formed between the sheet to be turned, the storage drum and the turning drum. A blowing device supplying air being at least one of compressed air and blast air that can be introduced laterally into the reduced-pressure area is provided.

In accordance with an added feature of the invention, the storage drum has a lateral surface with at least one recess formed therein. The recess is open towards the lateral surface and into which the air can be blown laterally by the blowing device, and in a defined rotation-angle position of the storage drum there is a flow connection between the recess and the reduced-pressure area.

In accordance with an additional feature of the invention, the blowing device has a plurality of blowing nozzles disposed on opposite sides of the storage drum and are oriented such that with respect to one another that their streams of air come into contact with one another in at least one of the reduced-pressure area and in the recess.

In accordance with another feature of the invention, the storage drum has a length and the recess extends over the length and rotates together with the storage drum.

In accordance with a further feature of the invention, an introduction of the air into the reduced-pressure area is controlled on a basis of rotation angle.

In accordance with a concomitant feature of the invention, the storage drum simultaneously functions as an impression cylinder.

Other features which are considered as characteristic for the invention are set forth in the appended claims.

Although the invention is illustrated and described herein as embodied in devices for turning sheets in a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
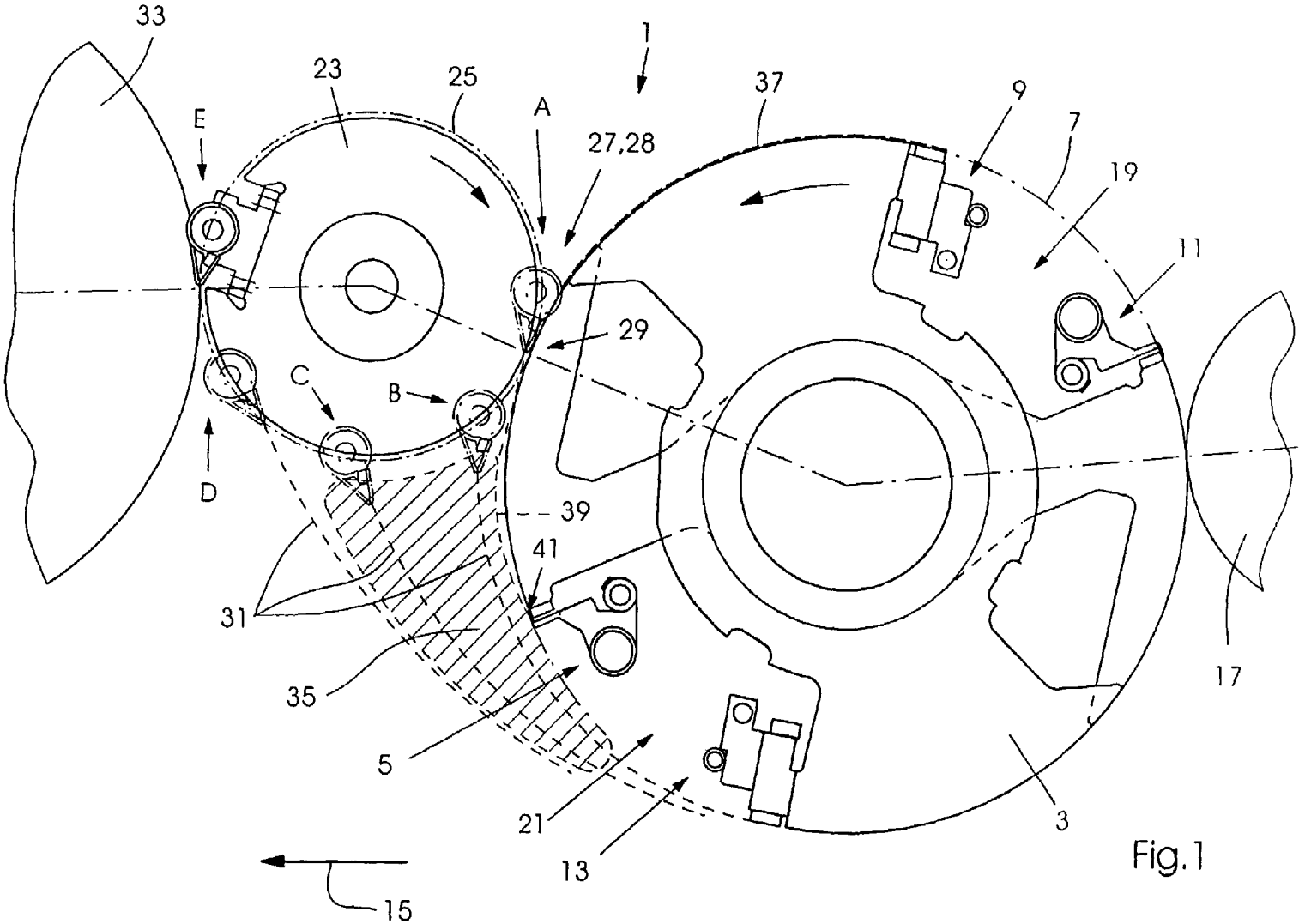
FIG. 1 is a diagrammatic, side-elevational view of an exemplary embodiment of a turning device for sheets according to the invention.

In all the figures of the drawing, sub-features and integral parts that correspond to one another bear the same reference symbol in each case. Referring now to the figures of the drawings in detail and first, particularly, to FIG. 1 thereof, there is shown a turning device 1 that can be used in general for turning sheets in a sheet-fed rotary printing machine which can be operated in a face-side printing mode and/or in a face-side printing and perfecting mode.

FIG. 1 shows a side view of an exemplary embodiment of the turning device 1 that is used to turn sheets in a sheet-fed rotary printing machine. The turning device 1 contains a storage drum 3, which has a first holding device 5 for a front edge—as seen in a direction of rotation of the storage drum 3—of a sheet resting on an outer lateral surface 7 of the storage drum 3. The storage drum 3 has a second holding device 9 for a rear edge of the sheet. Furthermore, a third holding device 11 is provided for the front edge of a subsequent sheet, and a fourth holding device 13 is provided for the rear edge of the subsequent sheet. The sheets are supplied—as seen in the direction of movement of the sheets (arrow 15)—from a cylinder 17 disposed upstream of the storage drum 3. The second holding device 9 and the third holding device 11 are disposed at a distance from one another in an open-edged first recess 19, which is introduced into an outer lateral surface 7, and the first holding device 5 and the fourth holding device 13 are disposed in an opposite, second recess 21. The recesses 19, 21 extend at least substantially over the entire length of the storage drum 3.

The first holding device 5 and the third holding device 11 are in this case clamping devices and each have a plurality of grippers which are disposed at a distance from one another and—as seen in a longitudinal direction of the storage drum 3—behind one another, hold the respective sheet in its front-edge area and fix the sheet in an accurate position on the outer circumferential surface of the storage drum 3. The second holding device 9 and the fourth holding device 13 are in this case formed by suction devices which each have at least one sucker, preferably a plurality of suckers disposed at a distance from one another and—as seen in the longitudinal direction of the storage drum 3—behind one another and with the aid of which the respective sheet can be held in its rear-edge area. As an alternative, the first and third holding devices 5 and 11 may also be configured as suction devices each with at least one sucker.

The second and fourth holding devices 9, 13 and the first and third holding devices 5, 9 hold the respective sheet clamped on the storage drum 3. At high machine speeds, the holding force of the suckers is not sufficient to prevent the sheet from being lifted off the storage drum 3. If the sheet-fed rotary printing machine has a high printing capacity, in-register, that is to say positionally accurate transfer of the respective sheet to a turning drum 23 disposed downstream of the storage drum 3 cannot be ensured with the aid of the holding devices 5, 9, 11, 13 alone.

The storage drum 3, on which two sheets can be stored in this exemplary embodiment, is of a two-part configuration. The two drum halves are of a comb-like structure and having tines which engage in one another, so that it is possible to adjust the storage drum 3 to the length of the sheets by changing the distance between the holding devices 5 and 9 and 11 and 13 associated in each case with a sheet. The two drum halves are preferably of exactly identical construction and have an accurately ground outer circumferential surface.

A distance between the turning drum 23 and the storage drum 3 is selected in such a manner that an outer lateral surface 25 of the turning drum 23 and the outer lateral surface 7 of the storage drum 3 almost touch one another. The turning drum 23 has a holding device 27 for engaging the rear edge of the sheet which is to be turned and is stored on the storage drum 3. The holding device 27, in this exemplary embodiment, is configured as a clamping device 28 which contains a plurality of grippers disposed at a distance from one another and—as seen in the longitudinal direction of the turning drum 23 behind one another. The structure and function of the clamping device 28, which in FIG. 1 is illustrated in five positions A to E, is known per se and therefore requires no further description here.

In an exemplary embodiment which is not illustrated in the figures, the holding device 27 of the turning drum 23 may also be formed by a suction device which has at least one sucker, preferably a plurality of suckers disposed—as seen in the longitudinal direction of the turning drum—one behind the other, which suckers can be used to take hold of the rear edge of a sheet which is to be turned. It is also conceivable for only a single sucker extending over the entire length of the turning drum 23 to be used.

The function of the turning device 1 is explained in more detail below on the basis of a turning operation. At a tangent point 29 between the storage drum 3 and the turning drum 23, which are almost touching one another, the rear edge of a sheet 31, which is held on the outer lateral surface 7 of the storage drum 3 with the aid of the holding devices 5, 9, is taken a hold of by the clamping device 28, which is situated in position A. In position B of the clamping device 28, the sheet 31, which is illustrated by dashed lines, has already been lifted off the outer lateral surface 7 of the storage drum 3 in its central and rear areas, while in the area of its front edge it is still resting on the outer lateral surface 7. In position C of the clamping device 28, the sheet 31 has been substantially entirely lifted off or detached from the storage drum 3, with what was previously the rear edge of the sheet now becoming the front edge. In position D of the clamping device 28, the sheet 31 has been completely lifted off the storage drum 3 and has already been turned. In the region of position E of the clamping device 28, the sheet is transferred to a cylinder 33 disposed downstream of the turning drum 23.

As a result of the sheet 31 which is held on the outer lateral surface 7 of the storage drum 3 being detached and carried along by the clamping device 28 of the turning drum 23, i.e. when the sheet is moved away from the storage drum 3, an area 35, which is illustrated by dashed lines in FIG. 1 and in which a pressure reduction prevails owing to the air entrained by the sheet 31, is formed between that side of the sheet which faces toward the storage drum 3, the turning drum 23 and the storage drum 3. The pressure reduction causes a sheet 37 which follows the sheet 31 and the front edge of which has approximately reached the tangent point 29, when the clamping device 28 holding the sheet 31 has reached position C, to begin to lift off the surface 7 of the storage drum 3. When the clamping device 28 is in position D, the front edge of the subsequent sheet 37 has reached a point 39 on the outer lateral surface 7, i.e. is already positioned inside the reduced-pressure area 35, and is lifted off the outer lateral surface 7 of the storage drum 3 by the pressure reduction prevailing in that area, as indicated in FIG. 1. When the clamping device 28 reaches position E, the front edge of the subsequent sheet 37 is situated at point 41. It can be seen that the subsequent sheet 37 is lifted off the outer lateral surface 7 of the storage drum 3 by the reduced pressure and the centrifugal forces acting on it, since the holding forces of the second and fourth holding devices 9, 13 which each have a plurality of suckers, are too weak.

To compensate for the pressure reduction which is formed when a sheet is being turned, or at least to reduce the pressure reduction to a level which causes no problems, the invention provides various possible solutions, which are explained in more detail below with reference to FIGS. 2 to 10. Components which are illustrated in FIGS. 2 to 10 and have already been explained with reference to FIG. 1 are provided with identical reference numerals, and therefore to this extent reference is made to the description given in relation to FIG. 1.

Figure 2:
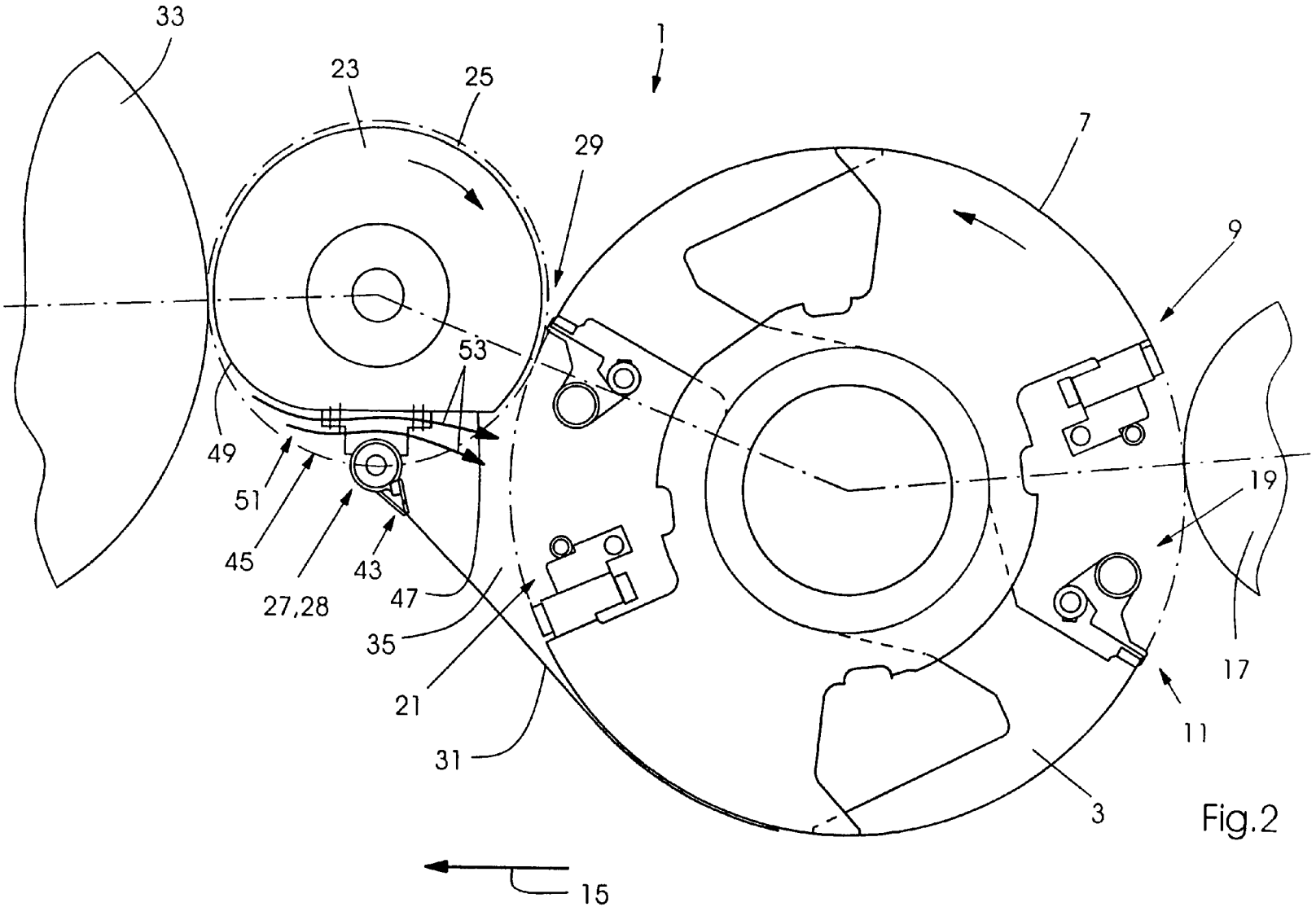
FIGS. 2 to 8 are side-elevational views of further exemplary embodiments of the turning device.

FIG. 2 shows a side view of a second exemplary embodiment of the turning device 1 according to the invention. The holding device 27 of the turning drum 23 has a plurality of grippers 43, of which only one gripper 43 can be seen in the illustration shown in FIG. 2. The grippers 43 are disposed at a distance from one another and are distributed one behind the other over the length of the turning drum 23. The grippers 43 are disposed on a flattened section 45 which is made in the outer lateral surface 25 of the turning drum 23 and, in this exemplary embodiment, extends over the entire length of the turning drum 23. The flattened section 45 forms a planar area 47 which is set back from the outer lateral surface 25, toward an axis of rotation of the turning drum 23, to which planar area the grippers 43 are releasably attached. At its end which follows the clamping device 28—as seen in the direction of rotation of the turning drum 23—the area 47 merges directly into the circular cross section of the turning drum 23, while the other end of the area 47 is adjoined by a curved wall section 49, which in this case extends over an angular range of approximately 70° and merges continuously into the outer contour of the turning drum 23. The radius of curvature of the wall section 49 is smaller than the radius of the turning drum 23. The flattened section 45 and an incision which is made in the outer lateral surface 25 and forms the curved wall section 49 produce a channel 51 which extends over the entire length of the turning drum 23 and, in this exemplary embodiment, extends over an angular range of approximately 140° and via which ambient air can flow into the reduced-pressure area 35, as indicated by arrows 53. This increases the amount of air which is introduced into the reduced-pressure area 35 via the channel 51. It is further possible to provide a blowing device (not illustrated in the figures), with the aid of which a blast-air or compressed-air stream can be blown into the channel 51.

In a third embodiment of the turning device 1, which is not illustrated in the figures, the turning drum has a plurality of flattened sections 45 as described with reference to FIG. 2, which are disposed one behind the other, as seen in the longitudinal direction of the turning drum 23, and each have a channel 51. The flattened sections 45 preferably are at least wide enough to accommodate in each case at least one gripper 43. Therefore, unchanged outer lateral-surface sections of the turning drum 23 remain in place between the channels 51, so that the turning drum 23 has improved strength/rigidity properties compared to the turning 23 drum with the continuous flattened section 45 described with reference to FIG. 2. Naturally, it is also possible for a channel which is formed by a recess, a groove or the like in the outer lateral surface of the turning drum, or a plurality of such channels additionally to be formed in an outer lateral section of the turning drum 23 which is situated between two grippers 43 and in which there is no holding element (gripper, sucker) of the holding device 27.

In the second embodiment illustrated in FIG. 2, the channel 51 is configured in such a manner that the air stream in the channel 51 is directed oppositely to the direction of rotation of the turning drum 23. The channel 51 is therefore oriented in such a manner that, in the event of a rotational movement of the turning drum 23, the ambient air is, as it were, scooped into the channel 51, so that a particularly large amount of air can be introduced into the reduced-pressure area 35 within a short time, so that it is possible to reliably prevent the subsequent sheet from being lifted off the storage drum 3. In a fourth exemplary embodiment, which is not illustrated in the figures, the channel 51 or the channels 51 may, for example, can also be configured and oriented in such a manner that the air flow is directed through the channel 51 in the direction of rotation of the turning drum 23. In this case, the air may, for example, be sucked in from that area of the machine that is situated above the tangent point 29. In this exemplary embodiment too, it is possible to introduce blast air or compressed air.

Figure 3:
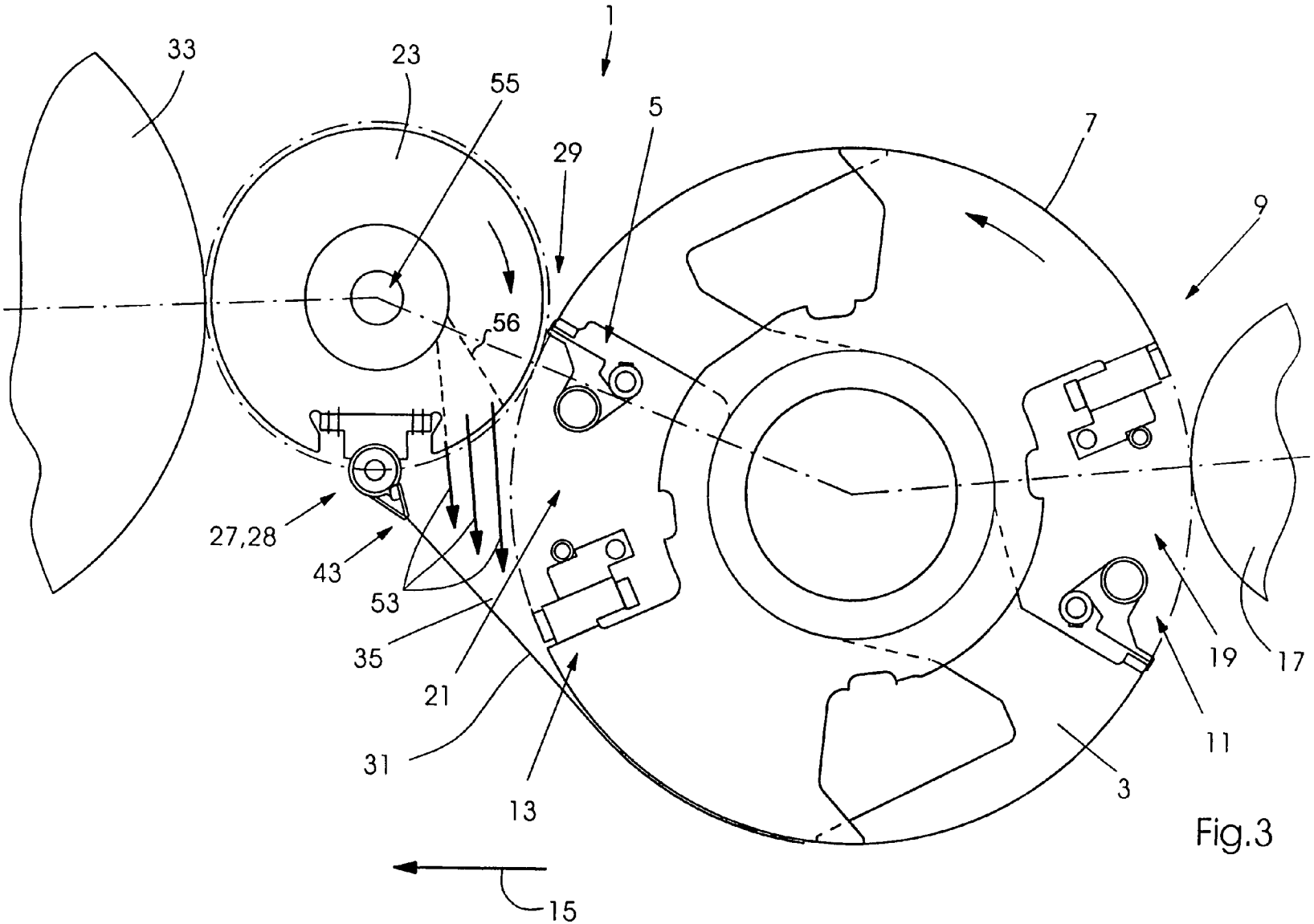

FIG. 3 shows a side view of a fifth exemplary embodiment of the turning device 1, in which the turning drum 23, in a circumferential area disposed upstream—as seen in the direction of rotation of the turning drum 23—of the holding device 27 has at least one passage orifice 56 that is connected to an inner chamber 55. According to a first variant, air is sucked out of the inner chamber 55 of the turning drum 23 into the reduced-pressure area 35 via the passage orifice 56 by the pressure reduction prevailing in the reduced-pressure area 35. This results in that the force acting on a subsequent sheet resting on the outer lateral surface 7 of the storage drum 3 is reduced to a level which does not cause any problems. In another variant, the inner chamber 55 is connected via a rotary leadthrough (not shown in FIG. 3) in a shaft journal of the turning drum 23, to which leadthrough a blast-air/compressed-air supply device is connected, so that blast air or compressed air can be blown into the reduced-pressure area 35, i.e. behind the turned sheets, via the passage orifice 56 in the lateral surface of the turning drum 23, as indicated by arrows 53. In an advantageous embodiment, a valve which is controlled by the rotation angle is provided in the blast-air/compressed-air feed line, such that the passage orifice is only supplied with blast air/compressed air when the turning drum 23 is in a rotary position in which there is a flow connection between the passage orifice and the reduced-pressure area 35.

The at least one passage orifice 56 in the lateral surface of the turning drum 23 may extend over the entire length of the turning drum 23 and over a defined circumferential angle in the circumferential direction thereof. As an alternative to the slot-like shape of the passage orifice 56, it is also possible to provide a plurality of passage orifices 56 which are distributed at intervals over the entire length of the turning drum 23 and via which air can be sucked or blown into the reduced-pressure area 35.

Figure 4:
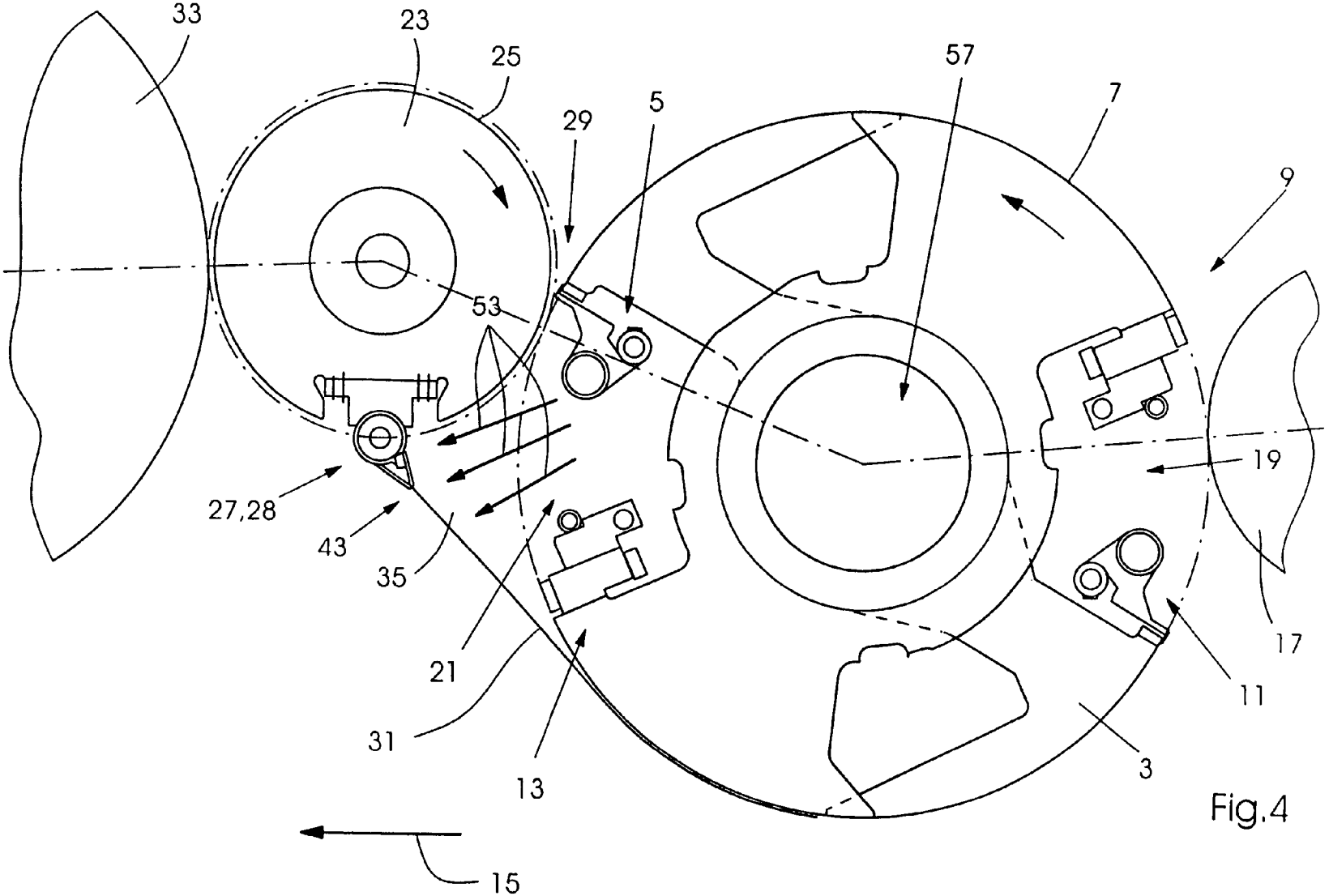

FIG. 4 shows a side view of a sixth exemplary embodiment of the turning device 1, in which the opposite recesses 19, 21 accommodating the holding devices 5, 13 and 9, 11 are each connected to an inner chamber 57 of the storage drum 3 via in each case at least one passage orifice (not shown), which inner chamber may be connected to the environment via a rotary leadthrough, which is formed by a bore or the like and is not shown in FIG. 4, in a shaft journal of the storage drum 3. In FIG. 4, the storage drum 3 is in a rotary position in which the recess 21 is disposed in the reduced-pressure area 35 or is situated opposite the reduced-pressure area 35. As indicated by the arrows 53, air is sucked in from the inner chamber 57 of the storage drum 3 by the pressure reduction prevailing in the area 35, with the result that the extent of pressure reduction in the reduced-pressure area 35 is reduced. When, during transfer of the subsequent sheet, the recess 19 is displaced into the reduced-pressure area 35, air can flow into the reduced-pressure area 35 via the recess 19. In this exemplary embodiment, the recesses 19, 21 extend over a circumferential area of the storage drum which is of a size which is such that, in a defined rotation-angle position of the storage drum 3, the recess 21 or 19 is disposed completely in the reduced-pressure area 35. Air is sucked into the reduced-pressure area 35 via the corresponding recess immediately after the sheet rear edge has been transferred from the holding device 9 or 13 to the turning drum 23.

In another exemplary embodiment of the turning device 1 illustrated in FIG. 4, the inner chamber 57 is connected to a blast-air/compressed-air supply device, for example via the rotary leadthrough, so that in a corresponding rotation-angle position of the storage drum 3, blast air/compressed air can be blown into the reduced-pressure area 35 via the recesses 19, 21. The supply of the blast air/compressed air to the recesses 19, 21 preferably is controlled on the basis of the rotation angle, i.e. the recesses 19, 21 are supplied with blast air/compressed air via the blast-air/compressed air supply device as soon as part of the corresponding recess 19, 21 has entered the reduced-pressure area 35. Otherwise, there is no blast air/compressed air supplied to the recesses 19, 21.

Figure 5:
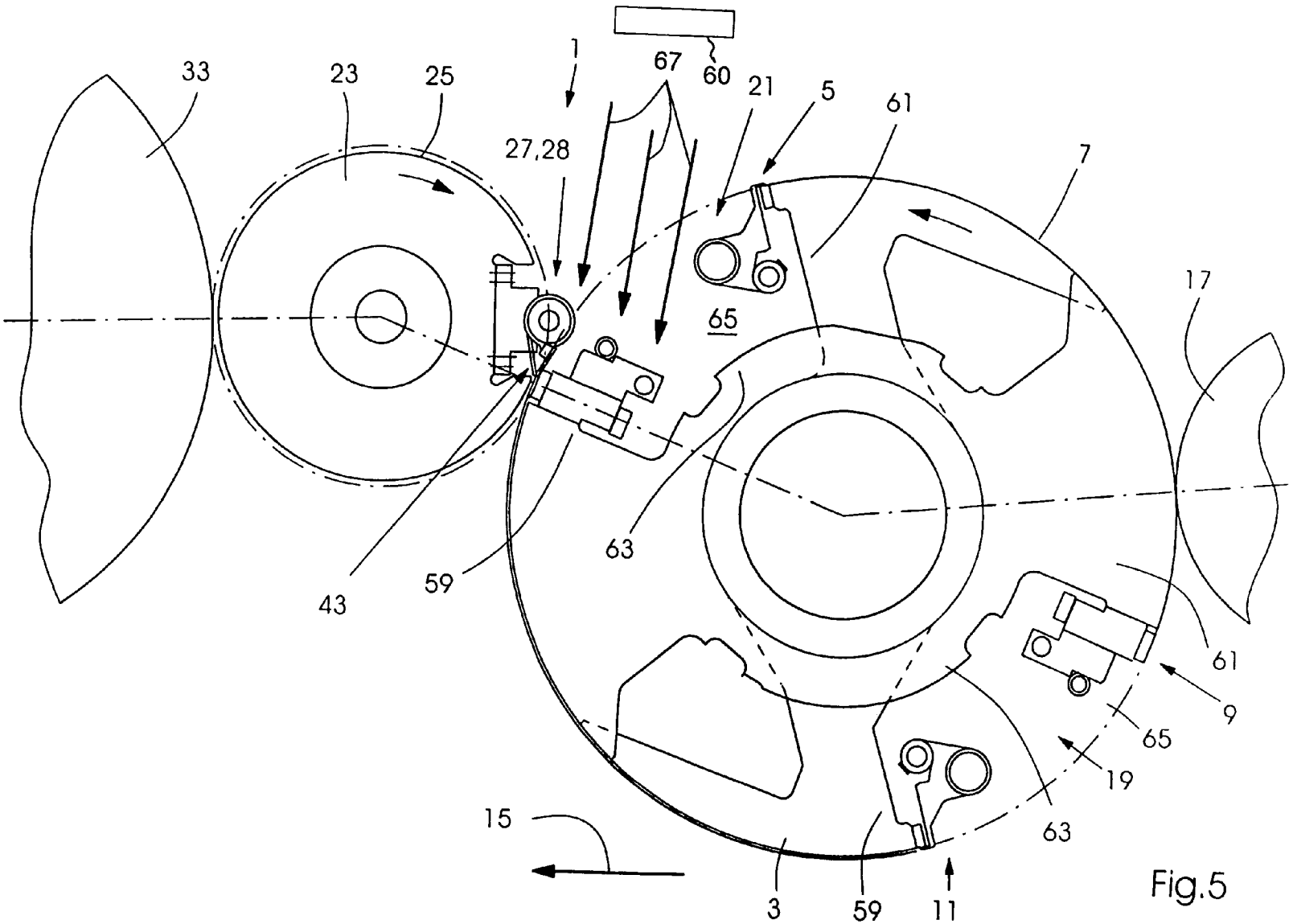

FIG. 5 shows a seventh exemplary embodiment of the turning device 1, which differs from the turning device described with reference to FIG. 4 only in that the recesses 21 and 19 are not connected to the inner chamber of the storage drum 3, but rather simply form chambers which are open toward the outer lateral surface 7 of the storage drum 3. The recess 19 is closed off in the circumferential direction of the storage drum 3 by side walls 59 and 61, at the base by a bottom 63 connecting the side walls 59, 61 and at the sides by end walls, of which only the end wall 65 can be seen in the illustration shown in FIG. 5. The recesses 19, 21 are of identical form, i.e. the recess 21 likewise has side walls 59, 61, a bottom 63 and end walls 65.

In the seventh exemplary embodiment of the turning device 1 illustrated in FIG. 5, a blowing device 60, which is connected to a non-illustrated blast-air/compressed-air supply device, is provided above the tangent point 29, in the region of the closing roll nip, between the turning drum 23, which is rotating in the clockwise direction, and the storage drum 3, which is rotating in a counter-clockwise direction, with the aid of the blowing device 60 blast air/compressed air can be introduced into the corresponding recess disposed upstream of the tangent point 29, in this rotational position of the storage drum 3 the recess 21, as indicated by arrows 67. The air that is forced into the recess can escape in the reduced-pressure area 35 as soon as the storage drum 3 is in a corresponding rotation-angle position. The "air cushion" which has been blown into the recess 19 or 21 leads to a reduction in the level of the pressure reduction in the reduced-pressure area 35 which is forming between the sheet to be turned, the turning drum 23 and the storage drum 3, so that it is possible to reliably prevent a subsequent sheet from being lifted off the outer lateral surface 7 of the storage drum 3.

Figure 6:
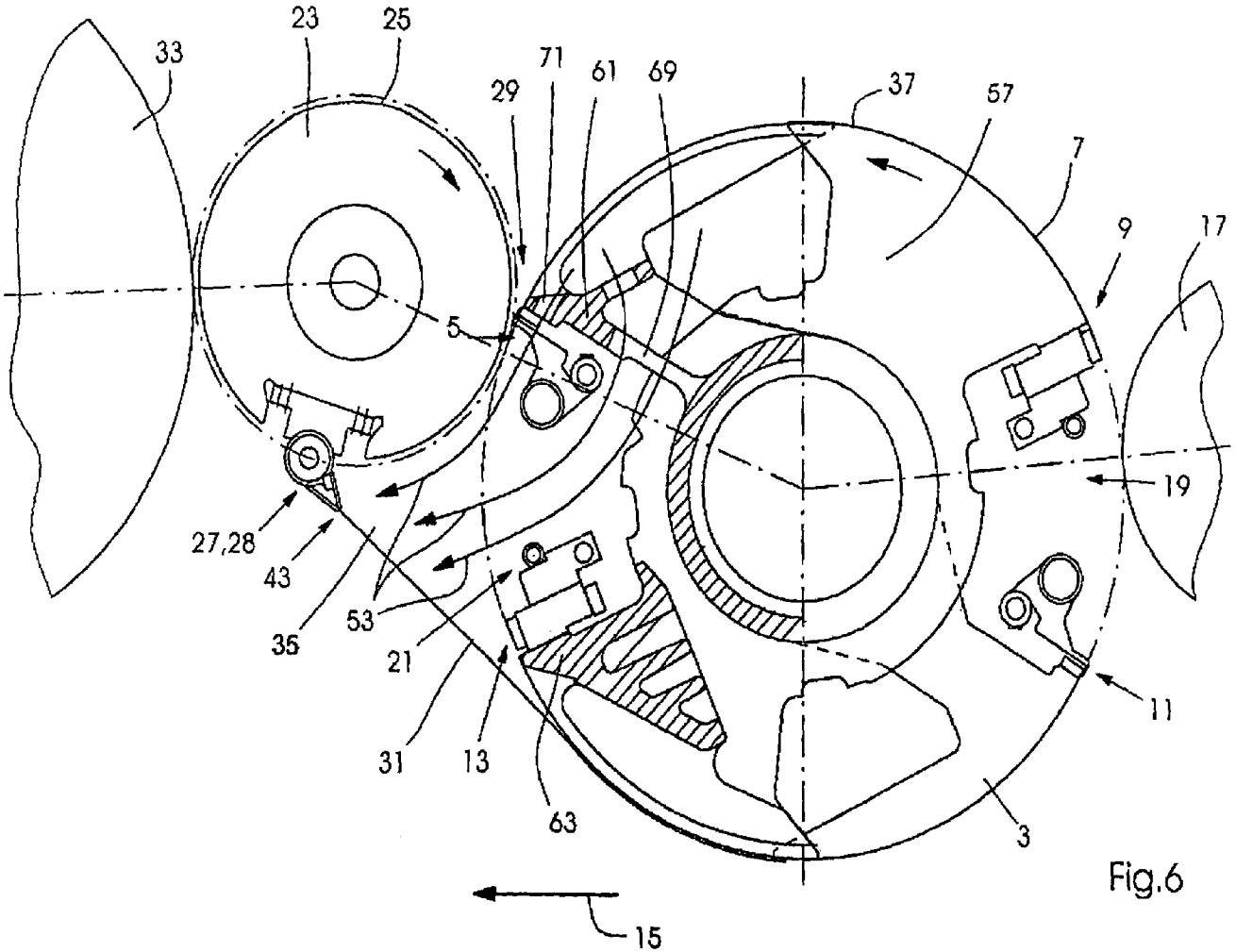

FIG. 6 shows a side view of an eighth exemplary embodiment of the turning device 1, in which passage orifices 69 and 71 are formed in the side wall 61 of the recess 21. Through the orifices 69, 71 a connection is formed between the recess 21 and a part of the inner chamber 57, from which air can be sucked into the reduced-pressure area 35 via the passage orifices 69 and 71 and the recess 21 as soon as at least part of the recess 21 is situated in the reduced-pressure area 35. The air streams from the interior of the storage drum 3 into the reduced-pressure area 35 are indicated by arrows 53.

The recess 19 also has at least one passage orifice (not shown in FIG. 6) which produces a connection between the inner chamber 57 of the storage drum 3 and the recess 19, so that air can also be sucked out of the inner chamber 57 into the reduced-pressure area 35 via the recess 19, if the storage drum 3 is in a corresponding rotation-angle position.

In an advantageous embodiment of the turning device 1 illustrated in FIG. 6, in each case at least one, and preferably a plurality of, the passage orifices are disposed in a part of the storage-drum lateral surface which is disposed upstream—as seen in the direction of rotation of the storage drum 3—of the first holding device 5 or the third holding device 11. Which passage orifices connects the outer lateral surface 7 of the storage drum 3 to the inner chamber 57, which in turn is connected via the passage orifices 69, 71 of the respective recesses 19 and 21. These passage orifices, for example in the case of a half-turn storage drum whose drum halves have intermeshing tines, are advantageously formed by the free spaces between the tines. In the lateral-surface area of the storage drum 3 which has the passage orifice(s), the subsequent sheet 37 is resting on the outer side, so that as a result of the air being sucked out of the inner chamber 57 into the reduced-pressure area 35, a pressure reduction is transferred to the underside of the sheet resting on the outer lateral surface 7. As a result, the sheet is preferably held smoothly against the outer lateral surface 7 in a secure position, so that it is possible to reliably prevent the sheet 37 from being lifted off even at a high circumferential speed of the storage drum 3. In this embodiment of the turning device, the air stream generated by the pressure reduction prevailing in the reduced-pressure area 35 therefore also simultaneously assists with fixing the next sheet to the storage drum 3, which sheet is held and clamped at its front edge and rear edge by the holding devices 5, 9 and 11, 13, respectively.

Figure 7:
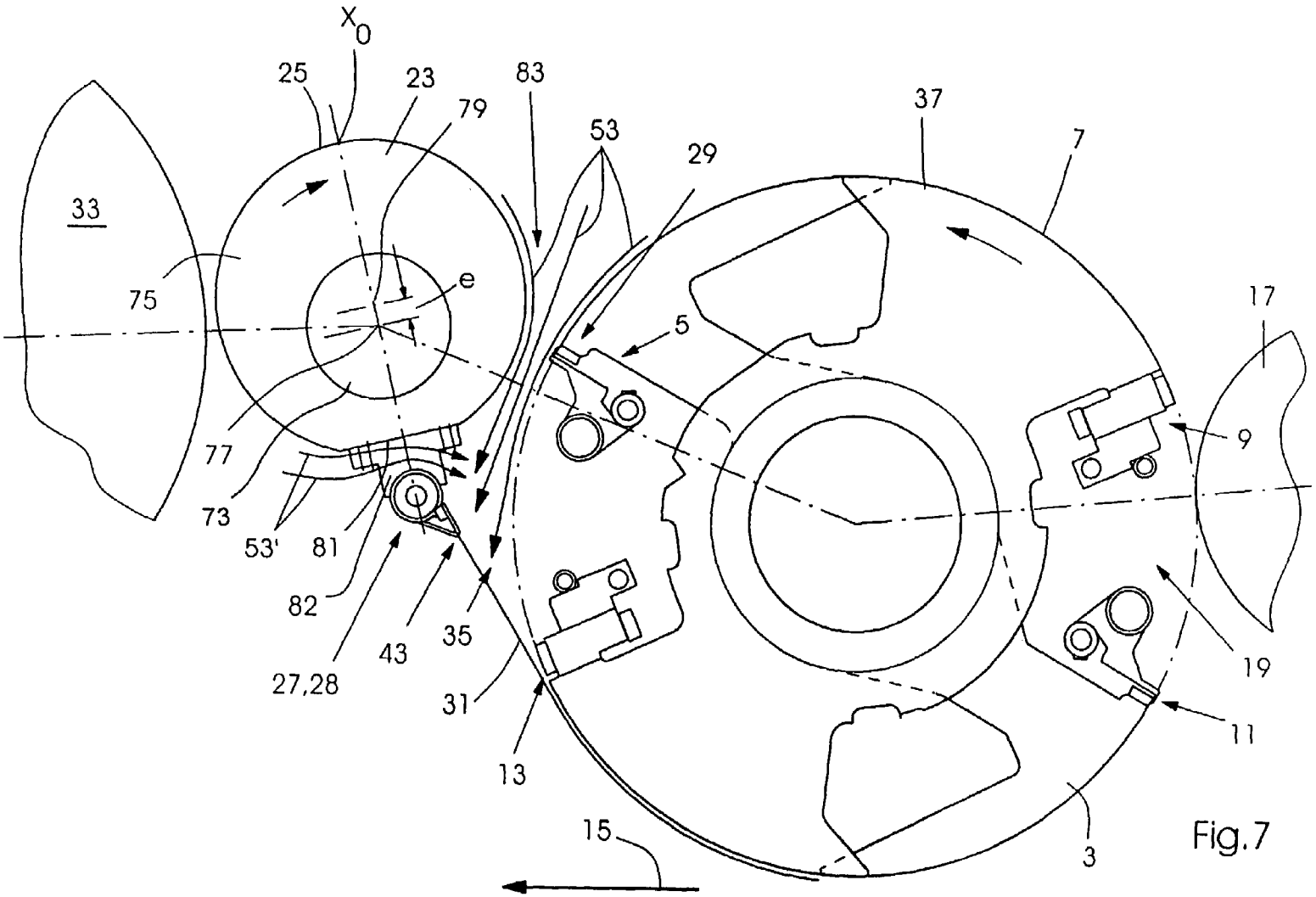

FIG. 7 shows a ninth exemplary embodiment of the turning device 1, in which the turning drum 23 is formed by an eccentric 75 connected to a drive shaft 73 in a manner fixed against rotation. This form of the turning drum 23 is particularly advantageous in terms of fabrication, and consequently the turning drum 23 can be produced easily and therefore inexpensively. The turning drum 23, an axis of rotation 77 of which has an eccentricity e with respect to a center point 79 of the eccentric 75, has a flattened section 81 extending over the entire or substantially the entire length of the turning drum 23 in its outer lateral surface 25, on which flattened section the holding device 27 formed by the clamping device 28 is disposed. The clamping device 28 has a plurality of the grippers 43 which are disposed one behind the other—as seen in the longitudinal direction of the turning drum 23—and of which only one gripper 43 can be seen in the illustration shown in FIG. 7. The grippers 43 are disposed at a distance from one another, with a preferably unobstructed interspace (not shown) between two grippers 43.

The grippers 43 of the clamping device 28, which in the event of rotation of the turning drum 23 follow a circular path around the axis of rotation 77, are disposed in such a manner that the unbalance resulting from the eccentric shape of the turning drum 23 is at least partially compensated for.

As a result of the eccentric mounting of the turning drum 23, a gap, which is referred to below as a free space 83, is formed between the outer lateral surfaces 7, 25 of the turning drum 23 and the storage drum 3. The free space 83 is smallest when the turning drum 23 is in a rotation-angle position in which a fixed point $X_0$ on the outer lateral surface 25 of the turning drum 23 is disposed in the region of the tangent point 29. In this rotational position of the turning drum 23, the outer lateral surface 25 is almost touching the outer lateral surface 7 of the storage drum 3. If, as illustrated by an arrow, the turning drum 23 then continues to rotate in the clockwise direction, the free space 83 initially increases in size. As a result of the rotation of the turning drum 23, the grippers 43 are displaced into their transfer position, in which the rear edge of the sheet to be turned is taken hold of. This transfer position is situated in the region of the tangent point 29. Since the grippers 43 are disposed on that side of the turning drum 23 which lies opposite the point $X_0$, at the moment at which the sheet rear edge is picked up, the outer lateral surfaces 7, 25 are at their maximum distance apart; at this moment, therefore, the free space 83 is at its largest. If the turning drum 23 continues to rotate in the clockwise direction, the free space 83—corresponding to the outer contour of the turning drum 23 in this exemplary embodiment—becomes continuously smaller again, until it is once again almost closed.

In the region of the tangent point 29, therefore, the rear edge of the sheet 31 is taken hold of by the grippers 43 and the operation of lifting this sheet off the outer lateral surface 7 of the storage drum 3 is commenced. Since the free space 83 and the above-described interspaces between in each case two grippers 43 continue to exist even when the sheet rear edge is picked up by the grippers 43, with a flow connection existing, via the interspaces, between the reduced-pressure area 35 which is forming as a result of the sheet being detached and turned and the surrounding area situated above the turning drum 23 and the storage drum 3, and ambient air being sucked in, it is possible to ensure that the pressure reduction forming in the area 35 is preferably only of a sufficiently low level for it to be possible to rule out the possibility of the subsequent sheet being lifted off the outer lateral surface 7 of the storage drum 3. As soon as the grippers 43 have passed through the tangent point 29, the ambient air can flow into the reduced-pressure area 35 from above even in the region of the grippers 43, which are now no longer blocking off the free space 83, as indicated by arrows 53. The incoming flow of ambient air through the free space 83 between the outer lateral surfaces 7, 25 and the corresponding interspace between two adjacent grippers 43 into the reduced-pressure area 35 is also assisted by the fact that the gap (free space 83) between the turning drum 23 and the storage drum 3, after the grippers 43 have passed the tangent point 29, becomes narrower and ambient air is forced into this gap by the body of the turning drum 23.

To supply the amount of air which is required in a very short time to the reduced-pressure area 35, it is also possible, if appropriate, for blast air or compressed air to be blown into the free space 83 from above and through the free space 83.

In the exemplary embodiment of the turning device 1 illustrated in FIG. 7, the clamping device 28 of the turning drum 23 is configured in such a manner that in each case a slot 82 is formed between the flattened section 81 and the grippers 43. Through the slot 82 it is also possible for ambient air and/or blast air/compressed air to flow into the reduced-pressure area 35, as indicated by arrows 53'.

To increase the amount of air flowing out of the environment, through the free space 83 between the turning drum 23 and the storage drum 3, into the reduced-pressure area 35, the turning drum 23 may also have at least one blade, for example in a similar way to a vaned fan, which improves the flow of air into the free space 83 or supplies controlled amounts of air to the free space 83, which then passes from the free space into the area 35 in order to reduce the level of the pressure reduction forming in that area. This blade may, for example, be disposed in the area between two grippers 43 or—as seen in the direction of rotation of the turning drum 23—in an outer lateral-surface area disposed downstream of the grippers 43. The blade may also be formed integrally with the turning drum 23, i.e. the outer contour of the turning drum 23 is of blade-like form at least at one point. This embodiment of the turning drum is more complex to produce. Therefore, if this embodiment is used, manufacturing technology aspects have to be left out of consideration.

In another exemplary embodiment (not shown) of the turning device 1 explained with reference to FIG. 7, the holding device 27 has only one gripper 43 on the turning drum 23, which gripper is disposed on the flattened section 81 and extends at least substantially over the entire length of the turning drum 23. In this embodiment, when the gripper 43 passes through the tangent point 29, a connection between the environment and the reduced-pressure area 35 is suddenly opened up, since at the moment at which the sheet rear edge is taken hold of by the gripper 43, although the free space 83 between the outer lateral surfaces 7, 25 of the storage drum 3 and the turning drum 23 does exist, the gap itself is still closed by the gripper 43 and the flow connection is only produced when the gripper 43 moves past the tangent point 29. This embodiment of the turning drum 23 also has advantages over known turning drums in terms of production.

Figure 8:
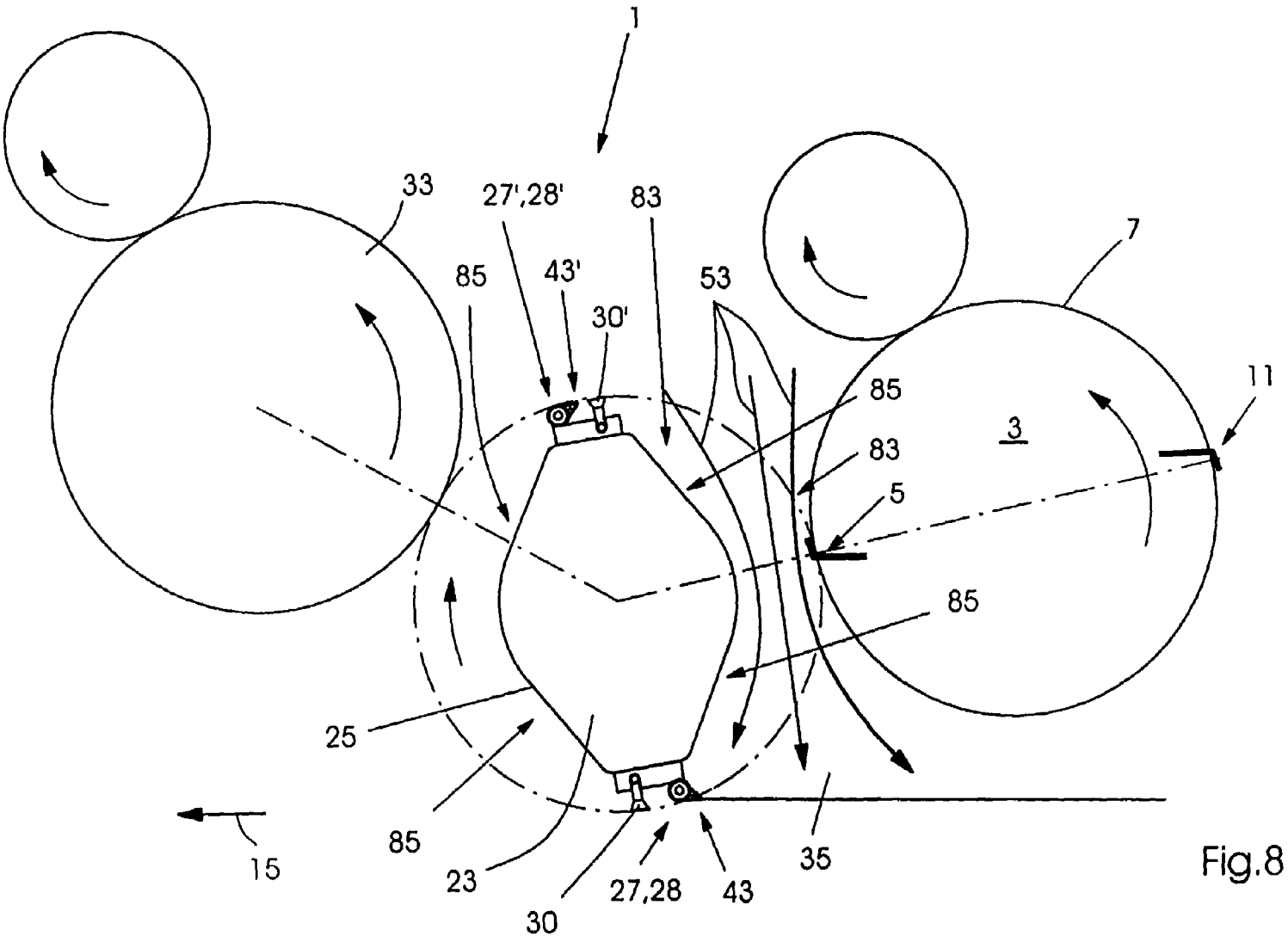

In the tenth embodiment of the turning device 1 illustrated in FIG. 8, the turning drum 23 has a basic body that is substantially elliptical in cross section. The shape of the turning drum body is formed, inter alia, by a plurality of flattened sections 85 on the outer lateral surface 25. Holding devices 27 and 27', which are disposed opposite one another, are provided on the turning drum 23. The holding devices 27, 27' are in this case formed by clamping devices 28 and 28', respectively, which have at least one, and preferably a plurality of the grippers 43 or 43', respectively, for the rear edge of a sheet which is to be turned. The clamping devices 28, 28' are preferably of identical construction and each have at least one, and preferably a plurality of, lifting elements 30 and 30', respectively, which are formed, for example, by suckers and are disposed upstream—as seen in the direction of rotation of the turning drum—of the associated clamping device. The lifting elements 30, 30' are used to lift the sheet which is resting on the outer lateral surface 7 of the storage drum 3, which in this case is serving as an impression cylinder, in the region of its rear edge.

Since the outer contour of the turning drum 23 is not round, a free space 83 is formed between the turning drum body and the storage drum 3 when the turning drum 23 rotates, which free space 83 becomes larger and smaller again as the turning drum 23 rotates. Ambient air and/or blast air passes through the free space 83 into the reduced-pressure area 35, so that the level of the pressure reduction in the area 35 is reduced at least to a sufficient extent for it to be possible to rule out the possibility of a subsequent sheet being lifted off the storage drum 3.

Figure 9:
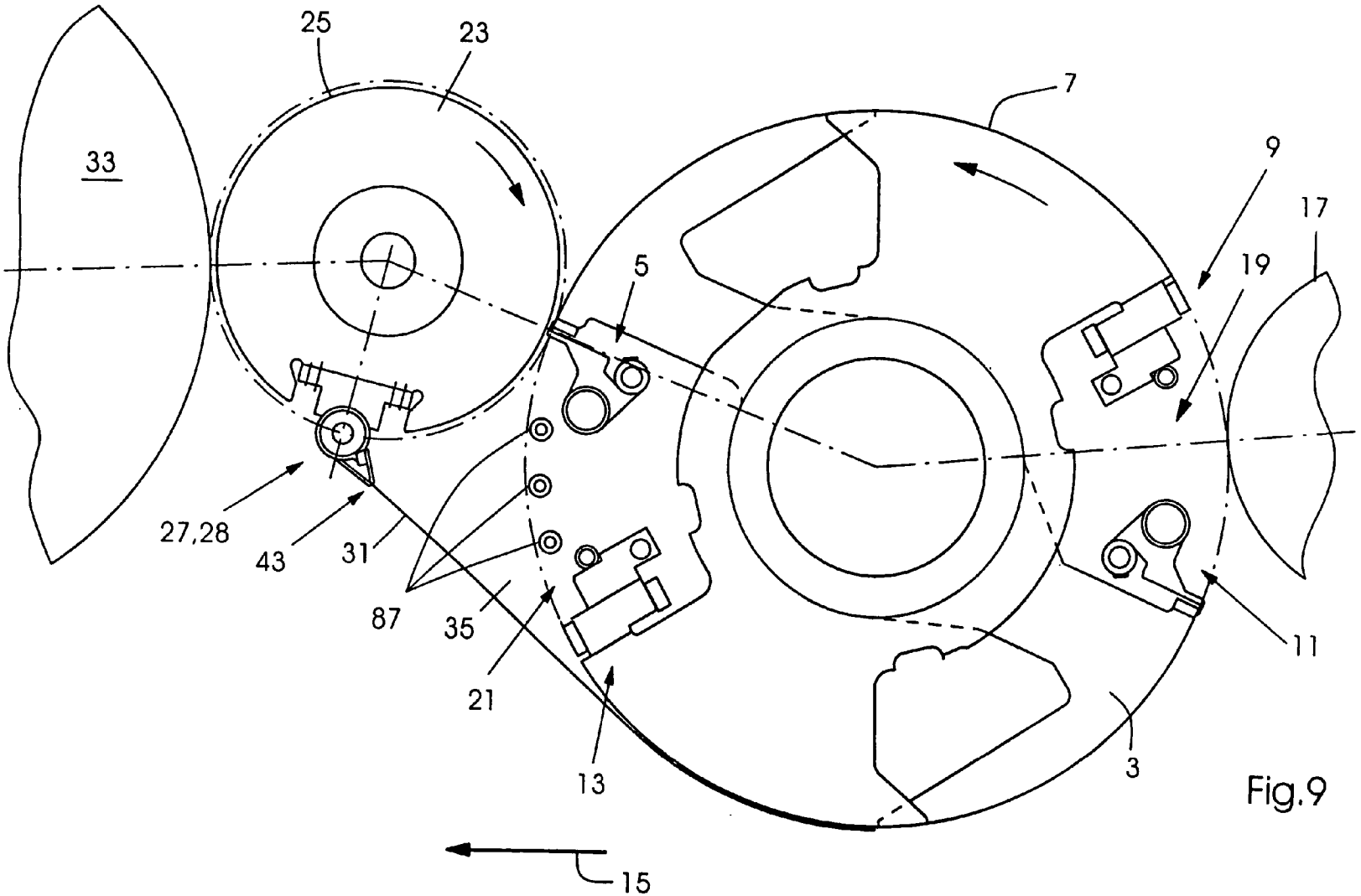
FIG. 9 is a side-elevational view of another exemplary embodiment of the turning device.
Figure 10:
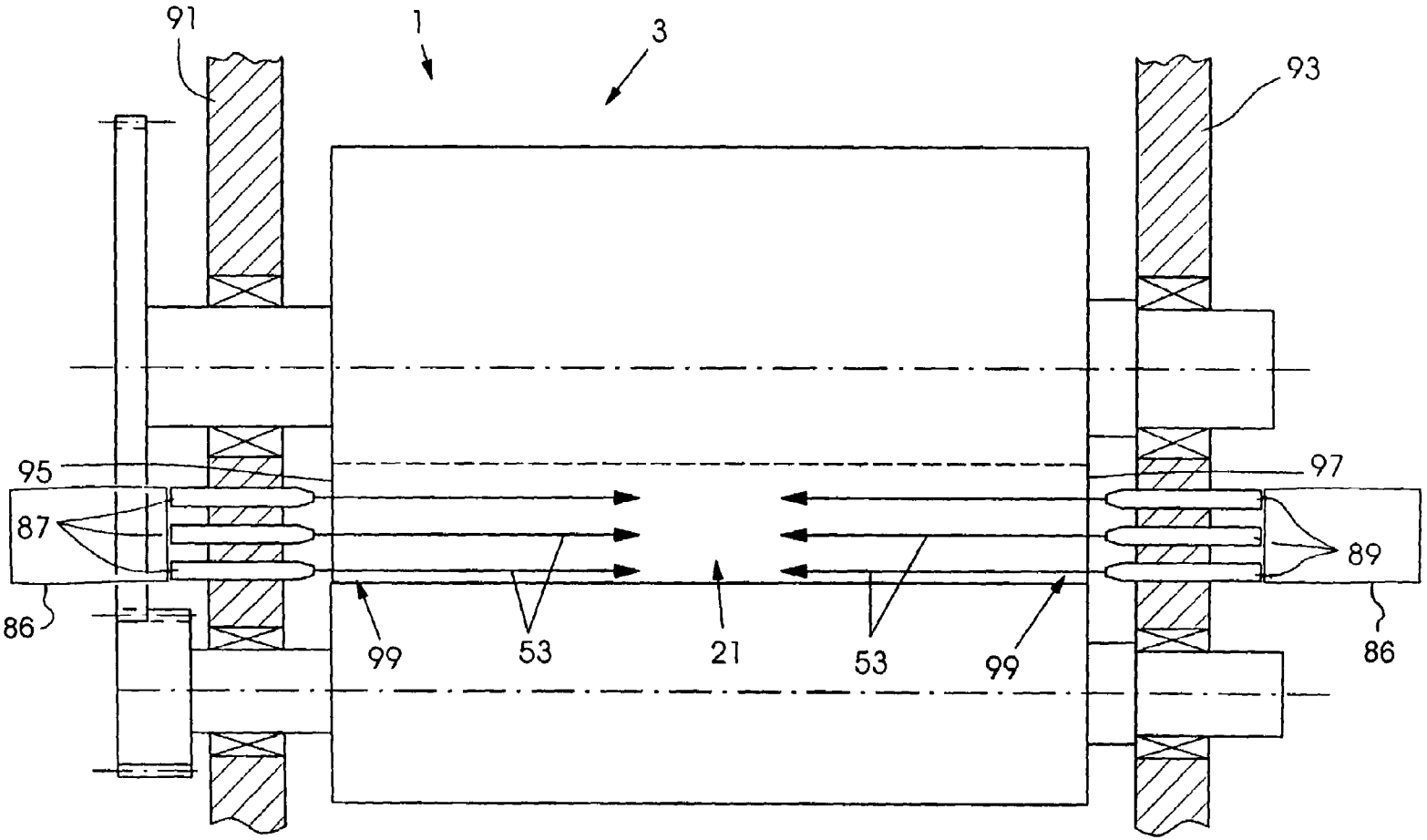
FIG. 10 is a cross-sectional view through the turning device illustrated in FIG. 9.

FIG. 9 shows a side view of an eleventh exemplary embodiment of the turning device 1, in which blast air/compressed air can be introduced into the reduced-pressure area 35 with the aid of a blowing device 86 connected to a non-illustrated blast air/compressed-air supply device. The blowing device 86 contains blowing nozzles, of which only three blowing nozzles 87 can be seen in the illustration shown in FIG. 9. Further blowing nozzles 89 of the blowing device 86 are illustrated in FIG. 10, which shows a cross section through the exemplary embodiment of the turning device 1 which is illustrated in FIG. 9.

The blowing nozzles 87 are disposed on a first bearing frame 91 of the sheet-fed rotary printing machine, and the nozzles 89 are disposed in a stationary position on the opposite side, on a second bearing frame 93. In this exemplary embodiment, at least the storage drum 3 is mounted rotably on the bearing frames 91, 93. As can be seen from FIG. 9, the blowing nozzles 87, and preferably also the blowing nozzles 89, are disposed on an imaginary circular path, the center point of which is on the axis of rotation of the storage drum 3. The configuration of the blowing nozzles 87, 89 is selected in such a way that, in a corresponding rotation-angle position of the storage drum 3, compressed air or blast air can be blown laterally into the first recess 19 or the second recess 21 extending over the entire length of the storage drum 3, which recesses are formed in the outer lateral surface 7 of the storage drum 3, as indicated by arrows 53. For this purpose, in each case at least one aperture 99 is provided in the region of the recesses 19, 21, in end walls 95 and 97 of the storage drum 3.

When the apertures 99 are congruent with the fixedly disposed blowing nozzles 87, 89, it is optionally possible for blast air or compressed air to be blown into the recess 21 or 19 which is serving as a distributor chamber for the air and this air can flow into the reduced-pressure area 35 via the open side of the recess 21 on the outer lateral surface 7 of the storage drum 3. The blowing nozzles 87, 89 are in this case aligned in such a manner that the blast streams (arrows 53) come into contact with one another in the central area of the storage drum 3.

As can be seen from FIG. 9, in this exemplary embodiment the blowing nozzles 87, and if appropriate also the blowing nozzles 89, are circular in cross section. Naturally, according to another embodiment (not shown), the blowing nozzles 87, 89 may also be configured in the form of slots.

Because the blowing nozzles 87, 89 are disposed in a stationary position, blast air or compressed air is supplied into the recesses 19, 21 using rotation angle control, since the blast air/compressed air can only be blown into the recess 19 or 21 when the apertures 99 are disposed opposite the blast nozzles 87, 89. Naturally, a cyclical feed of blast air/compressed air to the blowing nozzles 87, 89 is also possible.

A common feature of all the exemplary embodiments of the turning device 1 is that the reduced-pressure area 35 which is formed, during the turning of the sheet, between the storage drum 3, the turning drum 23 and that side of the sheet which faces toward the storage drum 3 can be reduced by supplying air to this area, either automatically or forced or assisted with the aid of at least one blowing device.

Also, the invention is not restricted to the exemplary embodiment(s) of the description. Rather, numerous amendments and modifications are possible within the scope of the invention, in particular those variants, elements and combinations which are inventive, for example, as a result of combining or modifying individual features or elements in combination with those which are described in the general description and the embodiments and are included in the drawings and which, by combinable features, lead to a novel subject.

I claim:

1. A sheet turning device for a sheet-fed rotary printing machine, comprising:

a storage drum for handling at least two sheets and having at least one holding device for each of the sheets, a circumferential surface, at least one open-edged recess formed therein, at least one inner chamber formed therein, and at least one passage formed therein and connecting said inner chamber of said storage drum to said circumferential surface; and a turning drum disposed downstream of said storage drum and having at least one holding device for engaging a rear edge of a sheet of the sheets to be turned, an operation of detaching the sheet to be turned from said storage drum and carrying it along by said turning drum leads to a formation of a pressure reduction in a reduced-pressure area formed between the sheet to be turned, said storage drum and said turning drum, and causes air from said inner chamber via said passage to be introduced through said open-edged recess into the reduced-pressure area.

2. The sheet turning device according to claim 1, wherein the air can be at least one of sucked from and blown into the reduced-pressure area via said passage.

3. The sheet turning device according to claim 1, wherein said reduced-pressure area is in communication with said circumferential surface of said storage drum via said passage, said circumferential surface of said storage drum has at least one of at least one further channel and at least one further passage orifice formed therein connecting said inner chamber of said storage drum to an area of said circumferential surface on which a subsequent sheet is resting.

4. The sheet turning device according to claim 1, including an air supply connected to said passage and selected from the group consisting of a compressed-air supply device, a blast-air supply device and the environment.

5. The sheet turning device according to claim 1, wherein said holding device of said storage drum is disposed in said open-edged recess.

6. The sheet turning device according to claim 1, wherein said turning drum has an inner chamber formed therein, a circumferential surface, and at least one passage orifice formed therein and connecting said inner chamber to said circumferential surface of said turning drum, and through said passage orifice air can be at least one of sucked from and blown into said reduced-pressure area.

7. The sheet turning device according to claim 1, wherein said passage is formed of a channel connected to a passage orifice.

* * * * *